US011286085B2

(12) United States Patent
Schoeberl et al.

(10) Patent No.: US 11,286,085 B2
(45) Date of Patent: Mar. 29, 2022

(54) PACKAGING, PACKING UNIT FOR A PACKAGING, AND METHOD FOR MANUFACTURING A PACKAGING

(71) Applicant: CARDBOX PACKAGING HOLDING GMBH, Vienna (AT)

(72) Inventors: Roland Schoeberl, Villach (AT); Klaus Hockl, Enns (AT)

(73) Assignee: CARDBOX PACKAGING HOLDING GMBH, Vienna (AT)

( * ) Notice: Subject to any disclaimer, the term of this patent is extended or adjusted under 35 U.S.C. 154(b) by 0 days.

(21) Appl. No.: 16/950,427

(22) Filed: Nov. 17, 2020

(65) Prior Publication Data

US 2021/0147119 A1 May 20, 2021

(30) Foreign Application Priority Data

Nov. 18, 2019 (DE) ..... 10 2019 131 104.7
May 8, 2020 (DE) ..... 10 2020 112 536.4

(51) Int. Cl.
*B65D 25/20* (2006.01)
*B65D 25/36* (2006.01)

(52) U.S. Cl.
CPC ..... *B65D 25/205* (2013.01); *B65D 25/36* (2013.01); *B65D 2203/12* (2013.01)

(58) Field of Classification Search
CPC ... B65D 3/16; B65D 3/26; B65D 3/28; B65D 25/20; B65D 25/205; B65D 25/36; B65D 51/24; B65D 77/24; B65D 77/245; B65D 2203/12; A45C 11/20
USPC ..... 206/459.5; 366/129; 220/735–736; 426/87, 115
See application file for complete search history.

(56) References Cited

U.S. PATENT DOCUMENTS 1,725,726 A * 8/1929 Ament ..... B67B 7/16 215/390
2,794,545 A 6/1957 Olson
3,828,999 A * 8/1974 Humphrey ..... B65D 77/245 229/401
3,908,887 A * 9/1975 Leto ..... B65D 77/245 220/574
4,218,010 A * 8/1980 Ruff ..... A47G 21/04 229/125.03

(Continued)

FOREIGN PATENT DOCUMENTS

AU 52911 90 A 10/1990
DE 195 09 100 A1 5/1996

(Continued)

OTHER PUBLICATIONS

German Patent Office Search Report, dated Aug. 19, 2020.
EPO Search Report, dated Apr. 14, 2021.

*Primary Examiner* — Bryon P Gehman
(74) *Attorney, Agent, or Firm* — Dority & Manning, P.A.

(57) ABSTRACT

A packaging for food includes a container to accommodate a food substance. An identifying element is disposed around the container that identifies the food substance. A functional element is associated with the container to remove the food substance from the container. The identifying element is indirectly and detachably connected to the container via the functional element. Upon removal of the functional element from the container, the identifying element is also removed from the container.

14 Claims, 7 Drawing Sheets

(56) References Cited

U.S. PATENT DOCUMENTS

| | | | | |
|---|---|---|---|---|
| 4,990,345 | A * | 2/1991 | Webb | B65D 77/245 206/205 |
| 5,788,076 | A | 8/1998 | Simmons | |
| 7,971,774 | B2 * | 7/2011 | Yaloz | B65D 3/06 229/401 |
| 8,210,381 | B2 * | 7/2012 | Cross | B65D 51/247 220/212.5 |
| 9,869,575 | B2 * | 1/2018 | Cross | B65D 51/247 |
| 10,438,516 | B2 * | 10/2019 | Key | G09F 3/0288 |
| 2005/0115965 | A1 | 6/2005 | Olson | |
| 2011/0100852 | A1 | 5/2011 | Goldburt | |

FOREIGN PATENT DOCUMENTS

| | | | | |
|---|---|---|---|---|
| DE | 20 2004 012 432 | U1 | 12/2005 | |
| DE | 20 2004 012 669 | U1 | 12/2005 | |
| DE | 20 2013 101912 | U1 | 8/2013 | |
| EP | 0 755 867 | A1 | 1/1997 | |
| EP | 2 440 474 | B1 | 4/2013 | |
| GB | 2 448 503 | A | 10/2008 | |
| JP | 2007197078 | A * | 8/2007 | B65D 77/24 |
| JP | 5471845 | B2 * | 4/2014 | |
| WO | WO 98/13270 | A1 | 4/1998 | |
| WO | WO 2011/031318 | A1 | 3/2011 | |
| WO | WO-2011031318 | A1 * | 3/2011 | B65D 3/26 |

* cited by examiner

PACKAGING, PACKING UNIT FOR A PACKAGING, AND METHOD FOR MANUFACTURING A PACKAGING

FIELD OF THE INVENTION

The present invention relates to a packaging, in particular for food, comprising a container for accommodating a, in particular, liquid and/or at least partially solid substance, an identifying element for identifying the substance, and at least one functional element for utilizing the substance. Moreover, the invention relates to a packaging unit for a packaging and to a method for manufacturing a packaging.

BACKGROUND

Two-piece packaging containers comprising a plastic cup and a cardboard sleeve are widely known from the related art. Due to the two-piece design, the following, slightly conflicting requirements additionally result, in contrast to one-piece variants of packaging containers. For the disposal, according to directions, of two-piece packaging containers of this type, the cardboard sleeve should be separated from the plastic cup. During the utilization of the packaging container, an unintentional separation of the cardboard sleeve and the plastic container should be avoided, however.

For this purpose, DE 195 09 100 A1 provides, in one advantageous embodiment, that an outwardly protruding bead extending essentially in parallel to the cup edge is provided at at least one outer surface of the plastic cup and that the inner side of the cardboard sleeve, in the assembled state of the plastic cup and the cardboard sleeve, comprises an inwardly protruding bulge directly above the bead of the plastic cup. The disadvantage thereof is that the cardboard sleeve and the plastic cup must be separated by the application of force, in order to achieve a disposal according to directions. Moreover, it is not ensured that this separation actually takes place during the consumption of the food.

A problem addressed by the present invention is therefore that of creating a packaging, a packaging unit for a packaging, and a method for manufacturing a packaging, which facilitates a separation of two-piece packaging, automatically guides a user to separate, and/or improves the recyclability of the packaging.

SUMMARY

The problem is solved by a packaging, a packaging unit for a packaging, and a method for manufacturing a packaging having the features set forth herein. Additional objects and advantages of the invention will be set forth in part in the following description, or may be obvious from the description, or may be learned through practice of the invention.

The invention relates to a packaging, in particular for food, comprising a container for accommodating a, in particular, liquid and/or at least partially solid substance, an identifying element for identifying the substance, and at least one functional element for utilizing the substance. The term "functional element" is understood to be an element, which is provided for utilizing the substance. This can be a piece of cutlery, in particular a spoon, fork, knife, spatula, and/or chopstick. It is also conceivable, however, that the functional element is a straw or a pouring aid for beverages. The term "identifying element" is understood to be an element, which is provided for identifying the substance provided for the container. The packaging is preferably designed as food packaging, in particular yogurt packaging. The container and the identifying element are indirectly detachably connected to each other via the at least one functional element in such a way that the identifying element separates from the container, in particular automatically, during the removal of the at least one functional element. According to the intended use, a user must therefore first detach the functional element from the identifying element in order to utilize the substance accommodated by the container. Due to the removal of the functional element, the indirect connection between the identifying element and the container is also automatically separated. As a result, the identifying element automatically detaches from the container. Advantageously, a separation of the identifying element from the container is therefore automatically carried out by the user when the user utilizes the functional element. As a result, a separation of the identifying element from the container is facilitated. Moreover, the user is automatically guided to separate the identifying element from the container. As a result, the recyclability of the packaging is advantageously considerably improved.

It is advantageous when the packaging is provided for food, for example, for yogurt. In this case, the container is preferably a cup for accommodating yogurt. The identifying element identifies the food, in particular the yogurt, that is accommodated in the cup. A mounted functional element, in particular a spoon, is used for utilizing, in particular scooping out, the yogurt. If the cup and the spoon are indirectly detachably connected to each other via the spoon, the identifying element separates from the cup during the removal of the spoon. As a result, these can be disposed of separately from each other without the need to apply additional force for this purpose.

It is advantageous when the container and the identifying element are detachably connected to each other exclusively in the region and/or via the at least one functional element. As a result, the separation of the identifying element from the container without other influencing variables can be ensured. It is also advantageous when the identifying element is connected to the container exclusively in the region of the functional element and/or exclusively via the functional element and via at least one adhesive, in particular a glue. Preferably, the functional element is connected to the container via a first adhesive and/or to the identifying element via a second adhesive.

In this regard, it is advantageous, moreover, when the at least one functional element is detachably connected to the container and/or to the identifying element. In this way, a separate disposal of the individual components can be ensured, according to demand.

Moreover, it is advantageous when the at least one functional element is at least partially a component of the container and/or of the identifying element. It is also advantageous when the at least one functional element is at least integrally formed with the container and/or the identifying element. Such a design can result in a simpler, faster, and/or more cost-effective production.

It is also advantageous when the at least one functional element is at least partially manufactured from the material of the container and/or of the identifying element. As a result, the at least one functional element can be disposed of jointly with the container and/or the identifying element. Additionally, a more cost-effective production can be achieved as a result.

It is advantageous when the container is manufactured from a first material, in particular plastic, and the identifying element is manufactured from a second material, in particular paper, cardboard, and/or paperboard. In this way, a material can be utilized for the container and for the identifying element that is suitable therefor, depending on their requirements.

Moreover, it is advantageous when the packaging, in particular the container and/or the identifying element, comprises at least one predetermined separation region. The term "predetermined separation region" is understood to be a region, which is specified by a spatial-physical design, such as material type, nature of the material, geometric design, and/or material weakening, and which is detached from the adjacent regions and/or elements and/or is destroyed upon the application of force. The predetermined separation region is preferably designed in such a way that, upon destruction of the predetermined separation region, the functional element can be separated from the container and/or the identifying element. Additionally or alternatively, the predetermined separation region is preferably designed in such a way that, upon destruction of the predetermined separation region, the identifying element is divided, and so the identifying element drops off the container. It is advantageous when the container and/or the identifying element comprise/comprises a first predetermined separation region, via which the functional element is connected, in particular indirectly and/or exclusively, to the container and/or to the identifying element. If the functional element is at least partially a component of the container and/or of the identifying element and/or is partially manufactured from the same material, the functional element can be separated from the container and/or from the identifying element in a targeted manner upon destruction of the first predetermined separation region. Additionally or alternatively, it is advantageous when the container and/or the identifying element comprise/comprises a second predetermined separation region. The second predetermined separation region is preferably formed between the functional element and the identifying element. This can be, in particular, a perforation and/or an adhesive bond, preferably an adhesive point. Additionally or alternatively, the second predetermined separation region is designed in such a way that a first section of the identifying element is connected to a second section of the identifying element via this second predetermined separation region. The two sections can be integrally formed or can represent two parts of the identifying element, which are separated from each other and/or are connected, in particular bonded, to each other. Upon destruction of the second predetermined separation region, the two sections of the identifying element are therefore detached from each other. As a result, the identifying element detaches from the container. It is advantageous when the two predetermined separation regions are combined with each other, in particular in such a way that they are destroyed, one after the other, when the functional element is separated out. The two predetermined separation regions can be arranged directly adjacent to one another and/or can follow each other, in particular in a transverse direction of the identifying element.

It is also advantageous when the predetermined separation region, in particular the first predetermined separation region, the second predetermined separation region, and/or a combination of these two, extends across the complete transverse direction of the identifying element. Consequently, the identifying element is divided upon destruction of the predetermined separation region, and so the identifying element drops off the container. In this way, the separation of the two sections of the identifying element from each other as well as the separation of the functional element from the container and/or from the functional element are further facilitated.

It is also advantageous when the predetermined separation region is a material weakening, in particular a perforation, fold, and/or thinning. In this way, an even simpler and more targeted separation of the at least one functional element from the container and/or from the identifying element is implementable.

It is also advantageous when the at least one functional element is connected, in particular bonded, in at least one connection region to the container and/or the identifying element. A connection region of this type is particularly advantageous when the one functional element is designed as two pieces with the container and/or the identifying element and/or is manufactured from different materials. Due to a connection region of this type, the functional element can be separated from the container and/or from the identifying element in a targeted manner.

It is also particularly advantageous when a glue situated in the at least one connection region is designed in such a way that the functional element can be detached from the container and/or from the identifying element without damage. In this way, an unrestricted function of the functional element after its separation can be ensured.

It is advantageous when the functional element is connected via a first connection region to the container and/or via a second connection region to the identifying element.

Moreover, it is advantageous when the functional element, the container, and/or the identifying element comprise/comprises at least one engagement region. This engagement region can be a tab, a bulge, or any other aid for engagement. In this way, the engagement in the functional element, the container, and/or the identifying element can be facilitated, in order to more easily separate these from each other.

It is also advantageous when the functional element comprises at least one folding contour. In this way, the functional element can be folded out of a basic shape into a functional shape, in order to ensure an easier utilization of the substance, in particular of the food. Using a spoon as an example, a flat and/or slightly curved basic shape, which is separated out, in particular, from the identifying element, can be folded into a functional shape, which comprises a stem end for gripping and/or a dish-like recess.

It is also extremely advantageous when the identifying element is designed as a closed ring, in particular a wrap, and/or encompasses the container at its outer circumference. It is conceivable that a ring closed in such a way, in particular a wrap, is manufactured with the aid of a sheet, in particular from paper, cardboard, and/or paperboard. For this purpose, the sheet is cut out in a necessary contour and is joined at its end to form a ring. Such a design has the advantage that it is very favorably and quickly manufactured.

Moreover, a packaging unit for a packaging, in particular according to the preceding description, comprising a container or an identifying element and comprising a functional element is provided. The at least one functional element is at least partially a component of the container or of the identifying element.

The functional element, the container, and/or the identifying element of the packaging unit can be designed according to at least one feature of the preceding description and/or the following description.

Moreover, a method is provided for manufacturing a packaging, in particular according to the preceding description, comprising a container for accommodating a substance, an identifying element for identifying the substance, and at least one functional element for utilizing the substance, wherein the identifying element and the functional element are mounted at the container, in particular from the outside. The container and the identifying element are indirectly detachably connected to each other via the at least one functional element. In this way, the identifying element can separate from the container during the removal of the at least one functional element.

The packaging can be designed according to at least one feature of the preceding description and/or the following description.

It is advantageous when the container and the identifying element are indirectly detachably connected to each other via the at least one functional element, and so the identifying element can separate from the container during the removal of the at least one functional element.

It is also advantageous when the container and the identifying element are exclusively indirectly detachably connected to each other via the at least one functional element.

It is also advantageous when the at least one functional element is detachably connected to the container and/or to the identifying element.

It is also advantageous when the container is manufactured from a first material, in particular plastic, and the identifying element is manufactured from a second material, in particular paper, cardboard, and/or paperboard.

It is also extremely advantageous when the functional element is connected to the container and/or to the identifying element via a predetermined separation region.

It is also advantageous when the functional element is connected, in particular bonded, in at least one connection region to the container and/or the identifying element.

BRIEF DESCRIPTION OF THE DRAWINGS

Further advantages of the invention are described in the following exemplary embodiments. Wherein.

DETAILED DESCRIPTION

Figure 1:
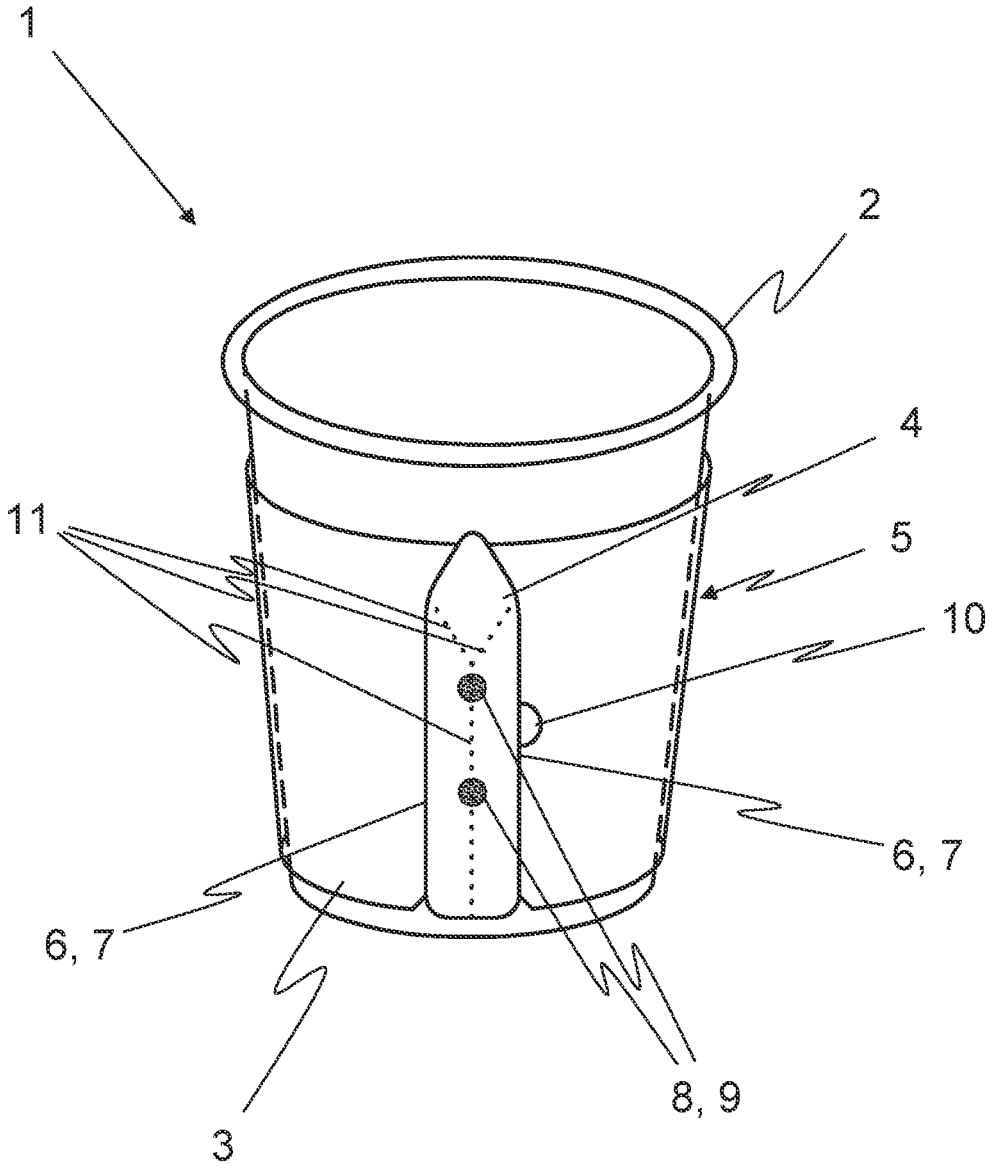
FIG. 1 shows a perspective view of a packaging according to one exemplary embodiment.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a perspective view of a packaging 1 according to a first exemplary embodiment. The packaging 1 comprises a container 2, an identifying element 3, and a functional element 4. In the present exemplary embodiment, the container 2 is designed as a round, tapered cup. The identifying element 3 encompasses the container 2 at its outer circumference. It is utilized for identifying a substance, in particular food, intended to be accommodated in the cup 2. Moreover, the identifying element 3 can be utilized for advertising a brand associated with the substance. Advantageously, the identifying element 3 reinforces the container 2, and so the container 2 can be designed to have thin walls. As a result, the container 2 can be designed in a material-saving manner. The identifying element 3 and the container 2 are preferably formed from materials that are different from each other. These are preferably materials that must be separated from each other for recycling reasons. The identifying element 3 is manufactured, in particular, from an environmentally friendly material, such as cardboard, paper, or paperboard. The container 2 is preferably manufactured from a non-environmentally friendly material, such as plastic.

In the example shown, the identifying element 3 and the functional element 4 form a packaging unit 5 of the packaging 1. In this case, the functional element 4 is at least partially a component of the identifying element 3. The functional element 4 is connected to the identifying element 3 via a first predetermined separation region 6, which can be, for example, a material weakening 7, in particular in the form of a perforation. A first predetermined separation region 6 of this type is therefore utilized for separating the identifying element 3 and the functional element 4 of the packaging unit 5 with the aid of the hands and/or without an additional tool. The first predetermined separation region 6 therefore preferably forms a predetermined breaking point. The first predetermined separation region 6 is irreparably destroyed during the separation of the functional element 4 from the identifying element 3.

The packaging unit 5 is detachably connected to the container 2 in at least one connection region 8. The detachable connection is preferably formed with the aid of a glue 9 situated in the connection region 8. The connection region 8 is formed between the functional element 4 and the container 2. The identifying element 3, however, rests loosely against the outer circumference of the container 2. Consequently, the identifying element 3 is indirectly connected to the container 2 in the connection region 8 via the functional element 4. Upon removal of the functional element 4, the functional element 4 is separated from the identifying element 3 in the first predetermined separation region 6. Simultaneously, the connection between the functional element 4 and the container 2 in the connection region 8 is also separated. As soon as the functional element 4 is removed from the identifying element 3, there is, consequently, also no longer a fastening, in particular an adhesive bond, between the identifying element 3 and the container 2.

As a result, the identifying element 3 is therefore also automatically detached from the container 2. The identifying element 3 therefore drops off the container 2 or can be easily removed from the container 2. When a user wants to utilize the functional element 4, he/she must therefore also imperatively separate the identifying element 3 from the container 2.

In the present exemplary embodiment, multiple connection regions 8 are formed in the region of the functional element 4. There is no force-locked connection between the identifying element 3 and the container 2. The identifying element 3 therefore rests loosely against the container 2. Consequently, the identifying element 3 separates from the container 2 after the functional element 4 has been removed.

In order for a user to more easily separate the functional element 4 from the identifying element 3, it is advantageous when the packaging unit 5 comprises an engagement region 10. This can be designed in the shape of a tab, as shown in FIG. 1. Due to gripping and pulling on this engagement region 10, in particular the tab, a simpler separation of the functional element 4 from the identifying element 3 is implementable. Instead of a tab, a recess can also be formed, in particular between the functional element 4 and the identifying element 3.

If the functional element 4 is therefore separated out of the identifying element 3, in particular via engagement into the engagement region 10, the, preferably integral, connection between the packaging unit 5 and the container 2 is also separated in the at least one connection region 8. The identifying element 3 is therefore connected to the container 2 exclusively indirectly via the functional element 4. As a result, when the functional element 4 has been removed, the identifying element 3 drops off the container 2. The consumer therefore does not need to deal with a separate disposal of the container 2 and of the identifying element 3 after the consumption of the substance, in particular food, located therein.

Figure 4A:
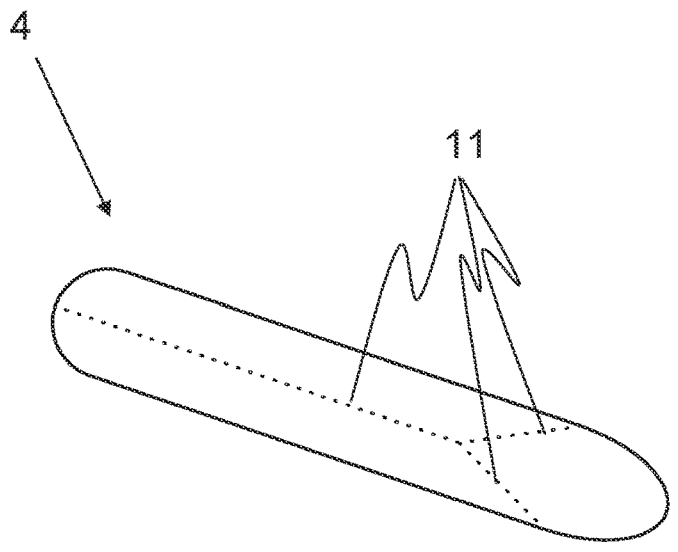
FIG. 4*a* shows a perspective view of a functional element in a basic shape according to one exemplary embodiment.
Figure 4B:
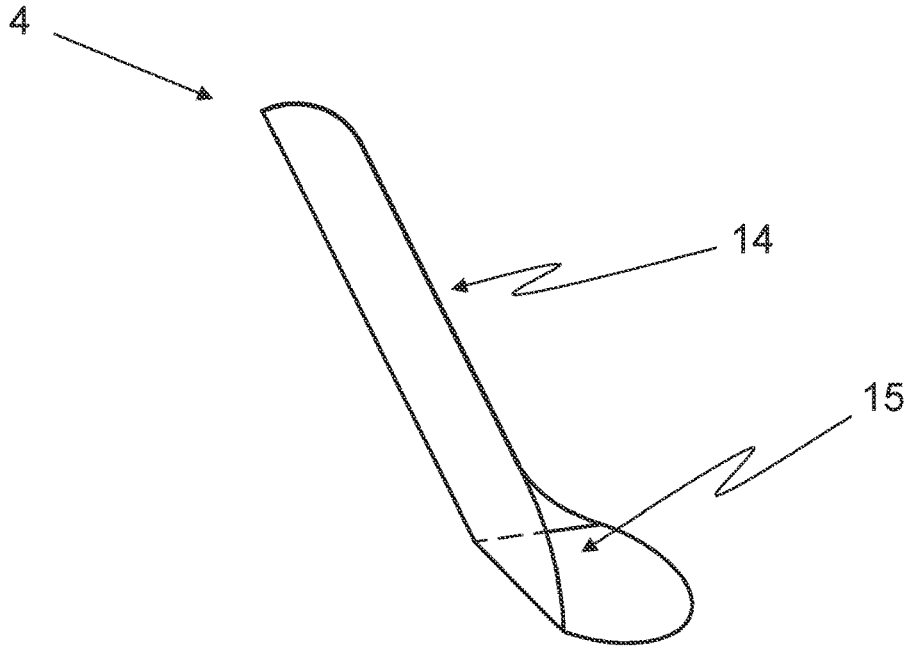
FIG. 4*b* shows a perspective view of a functional element in a functional shape according to an exemplary embodiment similar to FIG. 4.

In order to be able to more easily consume the substance located in the container 2, it is advantageous when the functional element 4, after having been separated out, can be brought into a functional shape (cf. FIGS. 4*a* and 4*b*). For this purpose, the functional element 4 comprises at least one folding contour 11. In the functional shape, the at least one functional element 4 can be, for example, a spoon, a fork, a knife, a spatula, or a chopstick.

Figure 2:
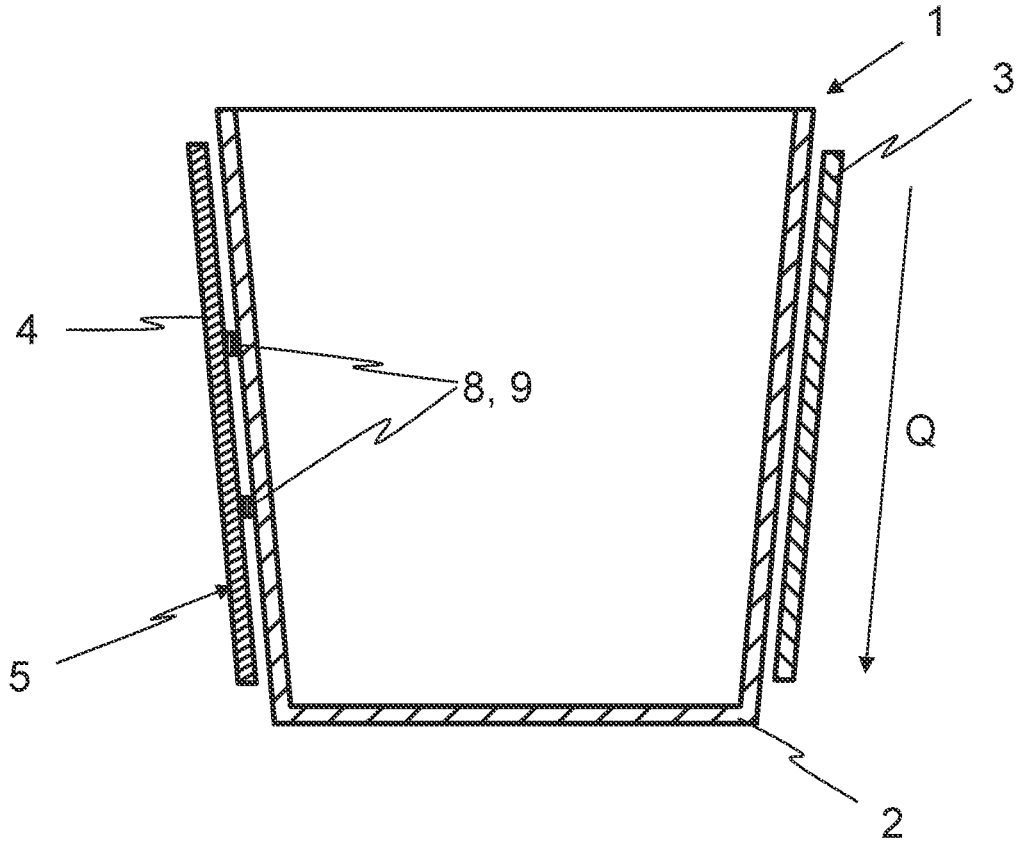
FIG. 2 shows a sectional representation of a side view of a packaging according to an exemplary embodiment similar to FIG. 1.

In FIG. 2, a lateral sectional representation of the packaging 1 according to one exemplary embodiment similar to FIG. 1 is represented. The section through the packaging 1 extends essentially centrally through the functional element 4. The features of the packaging 1 mentioned above with reference to the exemplary embodiment represented in FIG. 1 can be transferred onto one another and combined with each other. As is also represented in FIG. 1, the identifying element 3 is also indirectly connected to the container 2 via the functional element 4 in FIG. 2. The packaging unit 5 is detachably connected to the container 2 in the at least one connection region 8. The connection region 8 is formed between the functional element 4 and the container 2. The identifying element 3 is connected to the container 2 exclusively indirectly, in particular via the at least one functional element 4 and/or the at least one connection region 8.

There is no direct adhesive bond, therefore, between the identifying element 3 and the container 2. Therefore, if the functional element 4 is separated out of the identifying element 3 via the first predetermined separation region 6 shown in FIG. 1, the connection region 8 is also automatically separated. As a result, the identifying element 3 detaches from the container 2. Therefore, when the functional element 4 has been removed, the identifying element 3 drops off the container 2 in a transverse direction Q of the identifying element 3.

In FIGS. 3*a*, 3*b*, 3*c*, and 3*d*, top views of a packaging unit 5 in an unrolled shape according to further exemplary embodiments are represented. Alternatively, the exemplary embodiment of the packaging 1 represented in FIGS. 1 and 2 can comprise a packaging unit 5 according to the alternative embodiments represented in FIGS. 3*a*, 3*b*, 3*c*, and 3*b*. In this case as well, the packaging unit 5 comprises the identifying element 3 and the functional element 4, which are connected to each other and/or separable via the first predetermined separation region 6. The features of the packaging unit 5 mentioned above with reference to the exemplary embodiments represented in FIGS. 1 and 2 and those mentioned in the following with reference to the exemplary embodiments represented in FIGS. 3*a*, 3*b*, 3*c*, and 3*d* can be transferred onto one another and combined with each other.

Figure 3A:
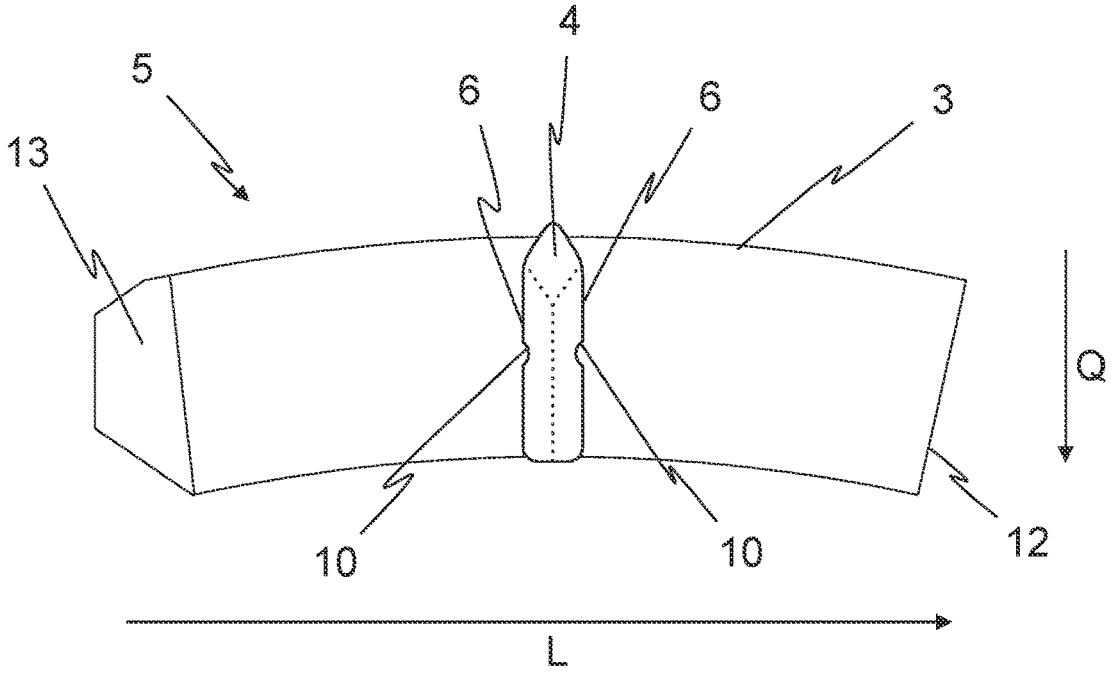
FIG. 3*a* shows a top view of a packaging unit in an unrolled shape according to one exemplary embodiment.

The packaging units 5 represented in FIGS. 1, 2, and 3*a* differ essentially only by the alternative engagement region 10. The packaging unit 5 shown in FIG. 3*a* comprises multiple, in particular two, engagement regions 10, whereas the packaging unit 5 shown in FIG. 1 comprises only one engagement region 10. Moreover, the engagement region 10, in particular the recess, according to FIG. 1 is formed in the identifying element 3, and the engagement regions 10, in particular recesses, according to FIG. 3*a*, are formed in the functional element. In FIG. 2, the representation of the engagement region 10 was omitted for the sake of greater clarity.

In the unrolled shape, the packaging unit 5 has a longitudinal direction L and the transverse direction Q. When the unrolled packaging unit 5 from FIG. 3*a* is wrapped around the container 2 along the longitudinal direction L, the wrap shown in FIGS. 1 and 2 arises. The packaging unit 5 is therefore designed as a wrap according to FIGS. 1 and 2. In order to retain the shape of the wrap, as shown in FIG. 3*a*, a free end 12 of the packaging unit 5 is fastened, in particular glued, at a fastening tab 13. In this way, it can be ensured that the wrap does not transition back into the unrolled shape.

Figure 3B:
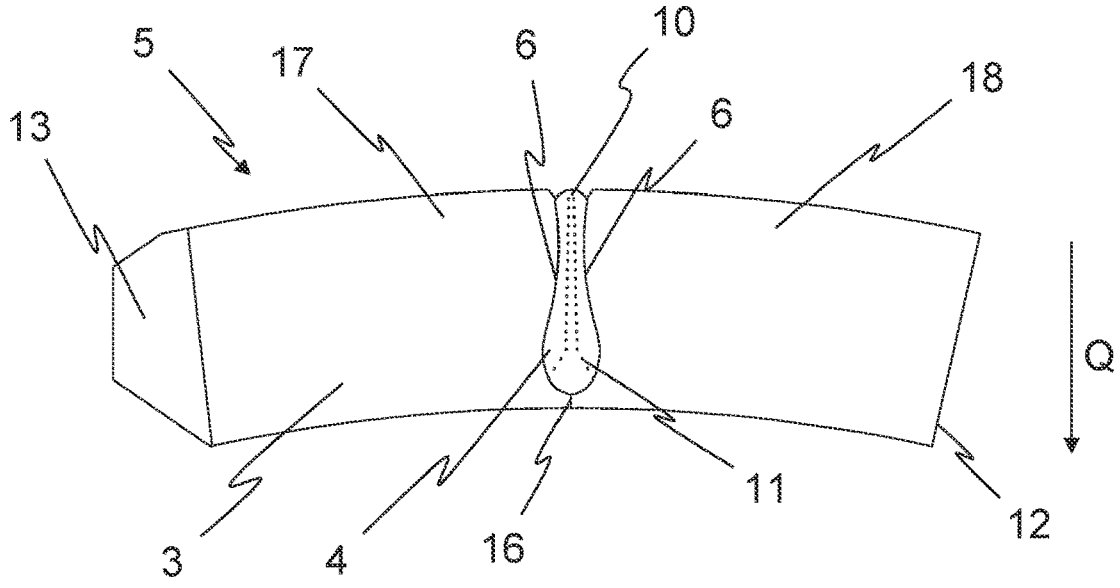
FIG. 3*b* shows a top view of a packaging unit in an unrolled shape according to one further exemplary embodiment.

FIG. 3*b* shows, similarly to FIG. 3*a*, an unrolled packaging unit 5. In contrast to the exemplary embodiment represented in FIG. 3*a*, the identifying element 3 comprises a second predetermined separation region 16. The functional element 4 forms an engagement region 10 at one end in the transverse direction Q of the identifying element 3. If the engagement region 10 is pulled, the functional element 4 separates from the identifying element 3 along the first predetermined separation region 6. Upon separation of the functional element 4 from the identifying element 3 via the first predetermined separation region 6, a first section 17 also separates from the second section 18 of the identifying element 3 due to the second predetermined separation region 16. Since the predetermined separation regions 6, 16 extend across the entire transverse direction Q of the identifying element 3, after the separation of the functional element 4, the first section 17 and the second section 18 are completely separated from each other.

Figure 3C:
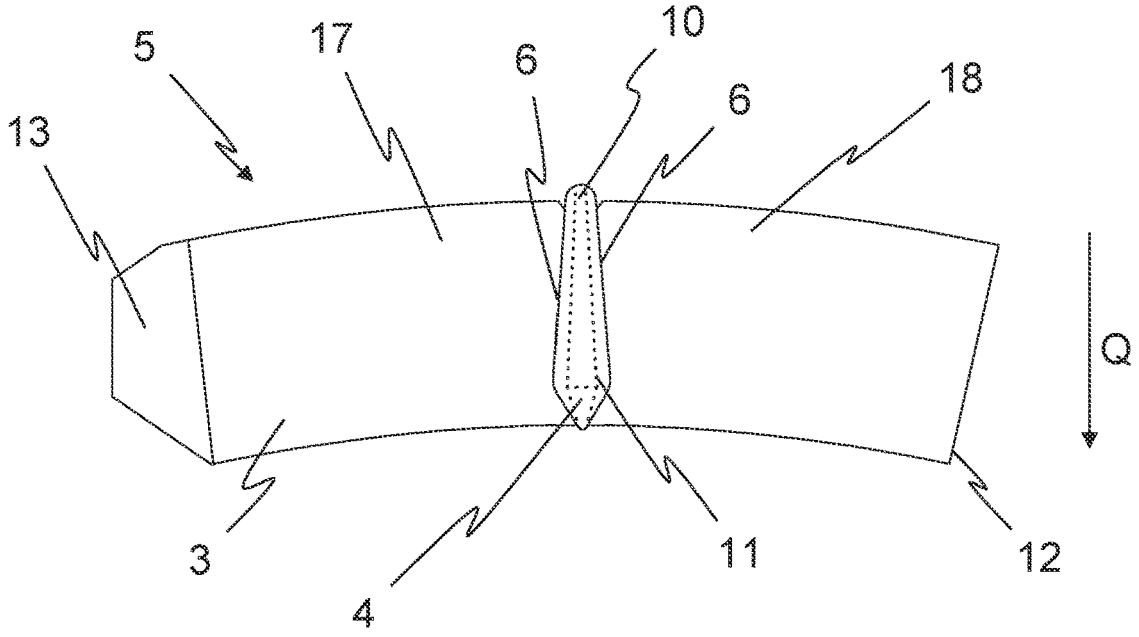
FIG. 3*c* shows a top view of a packaging unit in an unrolled shape according to one further exemplary embodiment.

In FIG. 3*c*, similarly to FIGS. 3*a* and 3*b*, an unrolled packaging unit 5 is represented. In contrast to the aforementioned exemplary embodiments, the functional element 4 extends across the transverse direction Q of the identifying element 3. The first predetermined separation region 6 therefore extends across the complete transverse direction Q of the identifying element 3. Upon separation of the functional element 4 from the identifying element 3 via the first predetermined separation region 6, the identifying element 3 divides into the first section 17 and the second section 18.

Figure 3D:
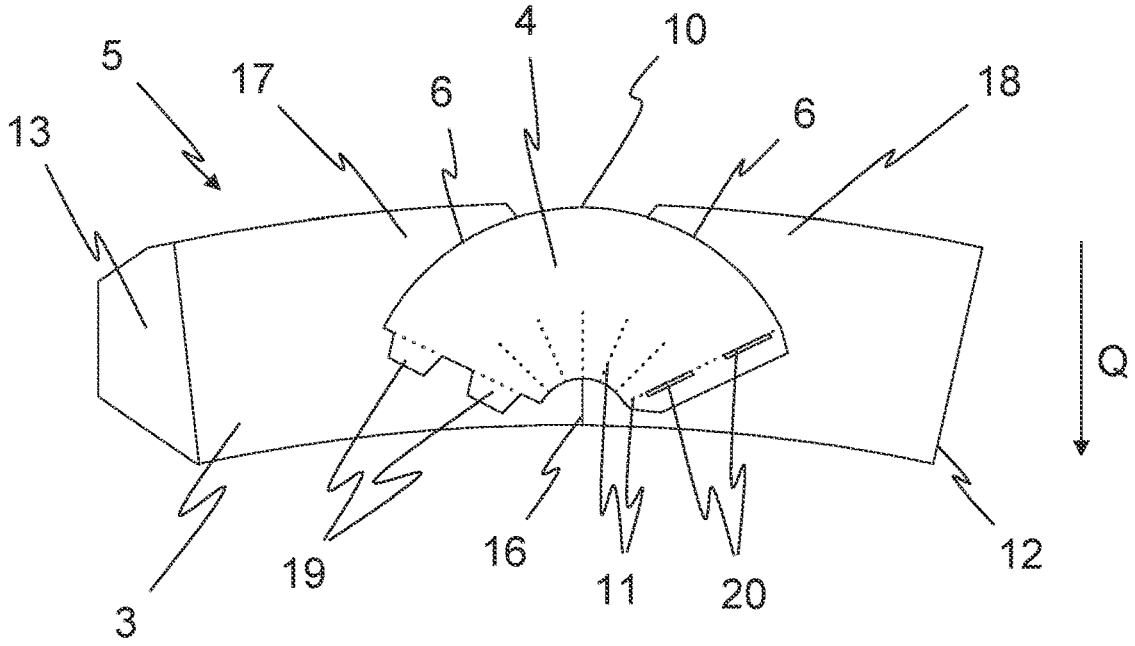
FIG. 3*d* shows a top view of a packaging unit in an unrolled shape according to one further exemplary embodiment.

FIG. 3*d* shows, similarly to FIGS. 3*a*, 3*b*, and 3*c*, an unrolled packaging unit 5. In contrast to the aforementioned exemplary embodiments, the functional element 4 is designed as a funnel. As is also shown in FIG. 3*b*, in this case as well, the first predetermined separation region 6 extends together with the second predetermined separation region 16 across the complete transverse direction Q of the identifying element 3. In contrast to the aforementioned exemplary embodiments, the functional element 4 comprises two insertion tabs 19 and two recesses 20. After the separation of the functional element 4 from the identifying element 3, the functional element 4 is folded along the folding contour 11 and the insertion tabs 19 are inserted into the recesses 20. A funnel therefore arises from the functional element 4.

In FIGS. 4*a* and 4*b*, a functional element 4, in particular for a packaging 1 and/or a packaging unit 5 according to the exemplary embodiments shown in FIGS. 1, 2, and/or 3*a*, is shown in different states. FIG. 4*a* shows the functional element 4 in a basic shape and FIG. 4*b* shows the functional element 4 in a functional shape. If the functional element 4 is mounted at a container 2 (see FIG. 1), it is in the basic shape. If the functional element 4 is separated from the container 2 and folded at its at least one folding contour 11, however, for use, the functional element 4 according to FIG. 4*b* is present in its functional shape. In the example shown, the functional shape of the functional element 4 comprises a stem end 14 for gripping and a dish-like recess 15 for accommodating the substance. The functional element 4 is therefore shaped as a spoon.

Figure 5:
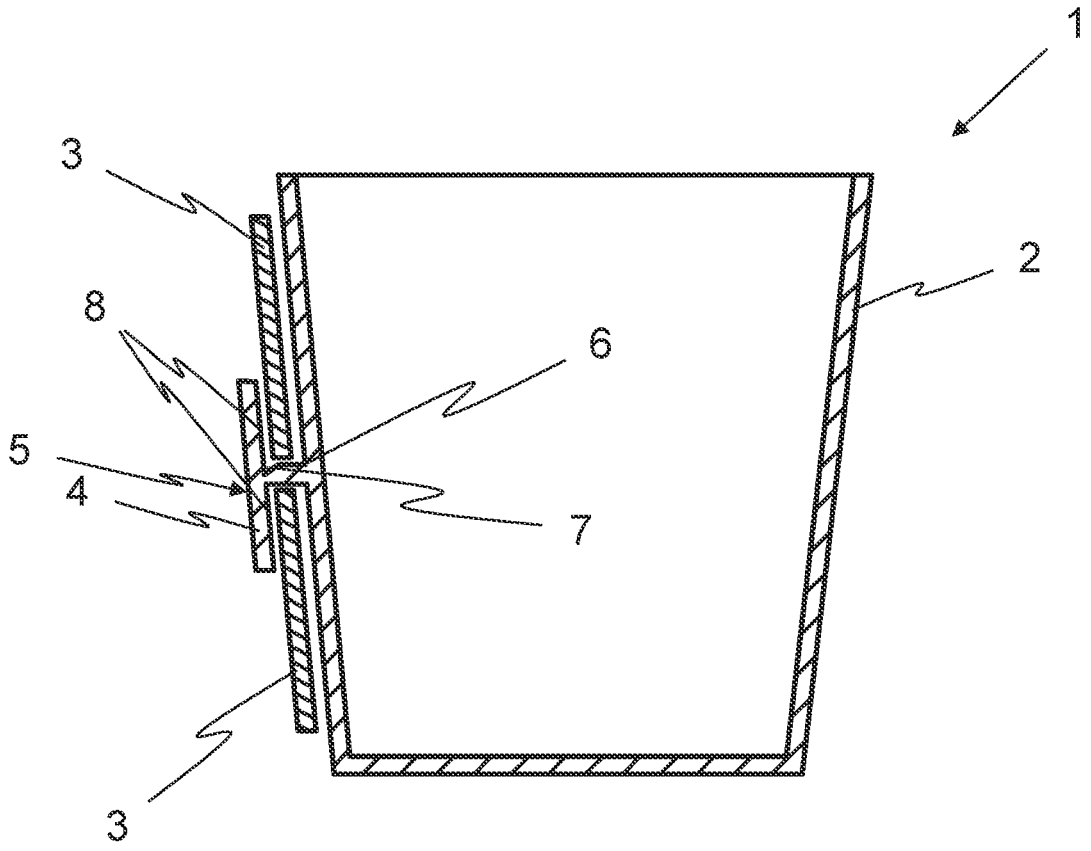
FIG. 5 shows a sectional representation of a side view of a packaging according to one further exemplary embodiment.

FIG. 5 shows a lateral sectional representation of the packaging 1 according to an alternative exemplary embodiment. In contrast to the preceding figures, in this case, the packaging unit 5 comprises the container 2 and the functional element 4. The identifying element 3 is connected to the functional element 4 via the connection region 8. This connection region 8 is formed by the surfaces of the functional element 4 that face the container 2. The surfaces hold the identifying element 3 at the container 2 in a form-locking manner. The identifying element 3 is therefore indirectly connected to the container 2 via the functional element 4.

The functional element 4 is connected to the container 2 via the first predetermined separation region 6. For easier separation, the first predetermined separation region 6 can comprise a material weakening 7, in particular a notch in the present example. If the functional element 4 is removed from the container 2, at least a portion of the first predetermined separation region 6 remains connected to the container 2. Since the identifying element 3 is held at the container 2 exclusively by the functional element 4, in particular in a form-locking manner, the identifying element 3 drops off the container 2 upon removal of the functional element 4. The consumer is therefore compelled to dispose of the container 2, the identifying element 3, and the functional element 4 separately from each other after the consumption of the substance, in particular food, located therein.

Figure 6:
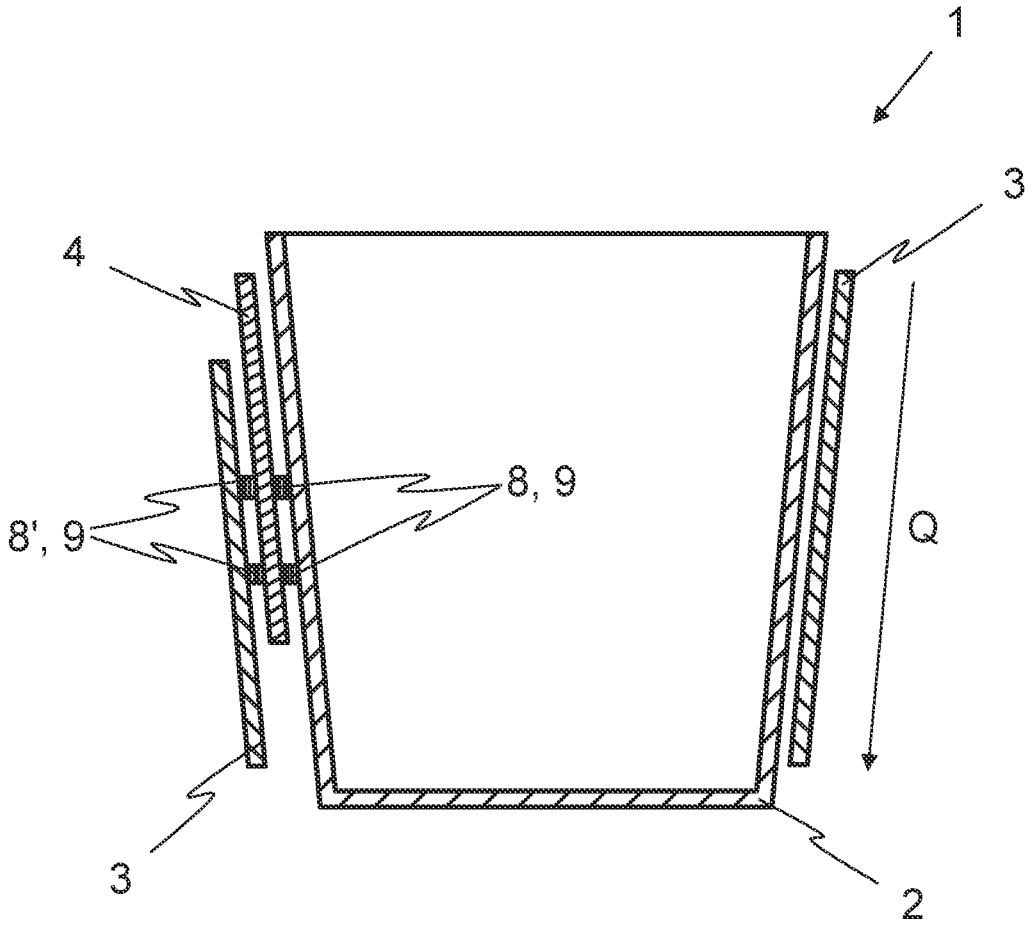
FIG. 6 shows a sectional representation of a side view of a packaging according to one further exemplary embodiment.

In FIG. 6, a lateral sectional representation of the packaging 1 according to one exemplary embodiment is represented. In contrast to the preceding figures, in this case, the functional element 4 is connected to the container 2 as well as to the identifying element 3 via the connection regions 8, 8'. The container 2 is connected via the first connection region 8 and the identifying element 3 is connected via the second connection region 8' to the functional element 4. The functional element 4 is arranged, in particular in a cross-sectional view, between the container 2 and the identifying element 3. The detachable connection between the identifying element 3 and the container 2 is formed by the glue 9 situated in the connection regions 8, 8'. The identifying element 3 is connected to the container 2 exclusively indirectly, namely via the at least one functional element 4 and the at least one connection region 8, 8', in particular via the particular glue 9 in the present case. There is no direct adhesive bond, therefore, between the identifying element 3 and the container 2. Consequently, the identifying element 3 is automatically detached from the container 2 upon detachment of the functional element 4. Additionally or alternatively, similarly to the exemplary embodiment from FIGS. 2 and 5, the functional element 4 can be connected to the container 2 and/or to the identifying element 3 via the first predetermined separation region 6.

Therefore, if the functional element 4 is detached from the container 2 via the first connection region 8, the second connection region 8' is automatically also separated. As a result, the identifying element 3 detaches from the container 2.

Therefore, when the functional element 4 has been removed, the identifying element 3 drops off the container 2 in the transverse direction Q of the identifying element 3.

Additionally, the identifying element 3 can comprise a predetermined separation region 6, in particular a material weakening 7, such as a perforation, in the region of the functional element 4. Upon removal of the functional element 4, the predetermined separation region 6 of the identifying element 3 is therefore additionally destroyed, and so the identifying element 3 can be more easily removed from the container 2.

The present invention is not limited to the represented and described exemplary embodiments. Modifications within the scope of the claims are also possible, as is any combination of the features, even if they are represented and described in different exemplary embodiments.

LIST OF REFERENCE NUMBERS

1 packaging
2 container
3 identifying element
4 functional element
5 packaging unit
6 first predetermined separation region
7 material weakening
8,8' connection region
9 glue
10 engagement region
11 folding contour
12 free end
13 fastening tab
14 stem end
15 recess
16 second predetermined separation region
17 first section
18 second section
19 insertion tab
20 recess
Q transverse direction
L longitudinal direction

The invention claimed is:

1. A packaging for food, comprising:

a container to accommodate a food substance;

an identifying element separate from and disposed around the container that identifies the food substance;

a functional element associated with the container to remove the food substance from the container, the functional element connected directly to the container and manually detachable from the container;

the identifying element retained relative to the container via connection of the identifying element to the functional element; and wherein upon a user first engaging and removing the functional element from the container, the identifying element is removed from the container along with the functional element.

2. The packaging of claim 1, wherein the identifying element is indirectly connected to the container exclusively via the connection of the identifying element to the functional element.

3. The packaging of claim 1, wherein the identifying element is detachably connected directly to the functional element.

4. The packaging of claim 1, wherein the functional element is integrally formed with one or both of the container and the identifying element.

5. The packaging of claim 1, wherein the functional element is formed from a same material as the container or the identifying element.

6. The packaging of claim 1, wherein the container is formed from a first material and the identifying element is formed from a different second material.

7. The packaging of claim 1, further comprising one or more engagement regions formed in one or both of the functional element and the identifying element via which the identifying element is connected to the functional element.

8. A packaging unit for use with the packaging of claim 1, wherein the packaging unit comprises one of; an integral formation of the identifying element and the functional element; or an integral formation of the functional element and the container.

9. A method for manufacturing the packaging of claim 1, comprising connecting the functional element directly to the container and connecting the identifying element indirectly to the container by attaching the identifying element directly to the functional element such that upon removal of the functional element from the container, the identifying element is also removed from the container.

10. A packaging for food, comprising:

a container to accommodate a food substance;

an identifying element disposed around the container that identifies the food substance;

a functional element associated with the container to remove the food substance from the container;

the functional element connected to the container;

the identifying element connected to the functional element such that upon removal of the functional element from the container, the identifying element is also removed from the container; and a first predetermined separation region via which the functional element is detachably connected to the identifying element and a second predetermined separation region via which a first section of the identifying element is connected to a second section of the identifying element.

11. The packaging of claim 10, wherein one or both of the first and second predetermined separation regions extend across a complete transverse direction of the identifying element.

12. The packaging of claim 10, wherein one or both of the first and second predetermined separation regions comprises a region of material weakening.

13. The packaging of claim 1, wherein the functional element is connected to the container at a connection region with a material such that the functional element is detachable from the container without damage to the functional element.

14. The packaging of claim 13, wherein the functional element is connected to the identifying element via a second connection region.

* * * * *